US010424872B2

(12) United States Patent
Van Den Brink

(10) Patent No.: US 10,424,872 B2
(45) Date of Patent: Sep. 24, 2019

(54) CONNECTOR SYSTEM HAVING FIT SECTIONS

(71) Applicant: TE Connectivity Nederland BV, s'Hertogenbosch (NL)

(72) Inventor: Ruud Van Den Brink, Beuningen (NL)

(73) Assignee: TE Connectivity Nederland BV, s'Hertogenbosch (NL)

( * ) Notice: Subject to any disclaimer, the term of this patent is extended or adjusted under 35 U.S.C. 154(b) by 0 days.

(21) Appl. No.: 15/443,579

(22) Filed: Feb. 27, 2017

(65) Prior Publication Data

US 2017/0179648 A1 Jun. 22, 2017

Related U.S. Application Data

(63) Continuation of application No. PCT/EP2015/066460, filed on Jul. 17, 2015.

(30) Foreign Application Priority Data

Aug. 27, 2014 (EP) ..... 14182437

(51) Int. Cl.

| | |
|---|---|
| ***H01R 13/64*** | (2006.01) |
| ***H01R 13/642*** | (2006.01) |
| ***H01R 12/70*** | (2011.01) |
| ***H01R 13/6593*** | (2011.01) |
| ***H01R 43/16*** | (2006.01) |
| ***H01R 43/18*** | (2006.01) |
| ***H01R 24/62*** | (2011.01) |
| *H01R 13/627* | (2006.01) |

(Continued)

(52) U.S. Cl.

CPC ..... *H01R 13/642* (2013.01); *H01R 12/7052* (2013.01); *H01R 13/64* (2013.01); *H01R 13/6593* (2013.01); *H01R 24/62* (2013.01); *H01R 43/16* (2013.01); *H01R 43/18* (2013.01); *H01R 12/7064* (2013.01); *H01R 13/6272* (2013.01); *H01R 27/02* (2013.01); *H01R 43/26* (2013.01); *H01R 2107/00* (2013.01)

(58) Field of Classification Search

CPC ..... H01R 13/64

USPC ..... 439/677, 660, 352, 357, 353

See application file for complete search history.

(56) References Cited

U.S. PATENT DOCUMENTS

| | | | |
|---|---|---|---|
| 3,491,330 | A | 1/1970 | Barnhart et al. |
| 5,267,882 | A | 7/1993 | Davis |

(Continued)

FOREIGN PATENT DOCUMENTS

| | | | |
|---|---|---|---|
| CN | 202695776 | U | 1/2013 |
| CN | 203250928 | U | 10/2013 |

(Continued)

OTHER PUBLICATIONS

Abstract of DE1020123008198, dated Oct. 31, 2013, 1 page.

(Continued)

*Primary Examiner* — Phuong K Dinh

(74) *Attorney, Agent, or Firm* — Barley Snyder

(57) ABSTRACT

A connector is disclosed. The connector has a plug and a jack receiving the plug. The plug has a plug housing surrounding a plurality of plug contacts and including a plurality of symmetric male fit sections. The jack has a jack housing supporting a plurality of jack contacts corresponding to the plurality of plug contacts. The jack housing includes a plurality of symmetric female fit sections.

19 Claims, 8 Drawing Sheets

(51) Int. Cl.

| | |
|---|---|
| *H01R 27/02* | (2006.01) |
| *H01R 43/26* | (2006.01) |
| *H01R 107/00* | (2006.01) |

(56) References Cited

U.S. PATENT DOCUMENTS

| | | | | |
|---|---|---|---|---|
| D453,320 | S * | 2/2002 | Sugino | D13/147 |
| 6,428,357 | B1 | 8/2002 | Dolinshek et al. | |
| 7,063,574 | B2 * | 6/2006 | Mazzullo | H01R 13/113 439/677 |
| 8,052,489 | B2 * | 11/2011 | Mase | H01R 13/4223 439/595 |
| 8,303,343 | B2 * | 11/2012 | Nagata | H01R 13/6582 439/607.54 |
| 8,573,999 | B2 | 11/2013 | Feldner et al. | |
| 8,684,769 | B2 * | 4/2014 | Kao | H01R 13/6471 439/607.28 |
| 9,318,856 | B2 * | 4/2016 | MacDougall | H01R 13/6581 |
| 2003/0157843 | A1 | 8/2003 | Thomas | |
| 2006/0079123 | A1 | 4/2006 | Mazzullo et al. | |
| 2010/0136819 | A1 | 6/2010 | Mase et al. | |
| 2010/0233905 | A1 | 9/2010 | Nagata | |
| 2011/0143594 | A1 | 6/2011 | Nagata | |
| 2014/0065870 | A1 | 6/2014 | Wang | |
| 2016/0056579 | A1 | 2/2016 | Lindkamp et al. | |

FOREIGN PATENT DOCUMENTS

| | | | |
|---|---|---|---|
| CN | 203721996 | U | 7/2014 |
| DE | 102012008198 | A1 | 10/2013 |
| EP | 0570650 | A1 | 11/1993 |
| EP | 1528636 | A1 | 5/2005 |
| EP | 2333910 | A1 | 7/2010 |
| EP | 2228871 | A2 | 9/2010 |
| JP | H2-3678 | U | 1/1990 |
| JP | 2004-531865 | A | 10/2004 |
| JP | 2010-218712 | A | 9/2010 |
| JP | 2011124147 | A | 6/2011 |
| WO | 2013081704 | A1 | 6/2013 |

OTHER PUBLICATIONS

European Search Report, dated Feb. 16, 2016, 8 pages.
PCT Notification concerning Transmittal of International Preliminary Report on Patentability, dated Mar. 9, 2017, 12 pages.
Notice of Reasons for Refusal, dated Feb. 16, 2018, 8 pages.
Chinese First Office Action, with English translation, dated Jul. 4, 2018, 20 pages.
Abstract of CN203721996U, dated Jul. 16, 2014, 1 page.
Abstract of CN203250928U, dated Oct. 23, 2013, 1 page.
Abstract of CN202695776U, dated Jan. 23, 2013, 1 page.
Notice of Reasons for Refusal, English translation, dated Jul. 31, 2018, 4 pages.
Japanese Notice of Reason for Refusal with English translation, Japanese Patent Application No. 2017-510544, dated Jan. 15, 2019, 5 pages.

* cited by examiner

CONNECTOR SYSTEM HAVING FIT SECTIONS

CROSS-REFERENCE TO RELATED APPLICATIONS

This application is a continuation of PCT International Application No. PCT/EP2015/066460, filed on Jul. 17, 2015, which claims priority under 35 U.S.C. § 119 to European Patent Application No. 14182437.5, filed on Aug. 27, 2014.

FIELD OF THE INVENTION

The present invention relates to a connector, and more particularly, to a connector comprising a plug and a jack.

BACKGROUND

A connector having a plug and a jack forming an electrical connection between at least eight contacts is known from DE 10 2013 103 069 B3, DE 10 2012 008 198 B4 or DE 10 2010 014 295 A1. Such known connectors connect data cables according to the CAT 5, CAT 6 or CAT 7 standards, however, the plug and/or the jack can also be accidentally networked with RJ 45 components regularly used in the network environment.

Modern production environments are further automated and have decentralized units to be controlled by a central data processing unit. Reliable control of each unit by the central data processing unit depends on reliable connections of data cables extending between the units and the central data processing unit. Sound electrical contact between the plug and the jack is of utmost importance to reliably operate units in modern production environments.

SUMMARY

An object of the invention, among others, is to provide a connector forming a secure connection between a plug and a jack while also preventing mis-mating. The disclosed connector has a plug and a jack receiving the plug. The plug has a plug housing surrounding a plurality of plug contacts and including a plurality of symmetric male fit sections. The jack has a jack housing supporting a plurality of jack contacts corresponding to the plurality of plug contacts. The jack housing includes a plurality of symmetric female fit sections.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

A connector according to the invention is shown in FIGS. 1-13 and comprises a plug 100 and a jack 200.

Figure 1:
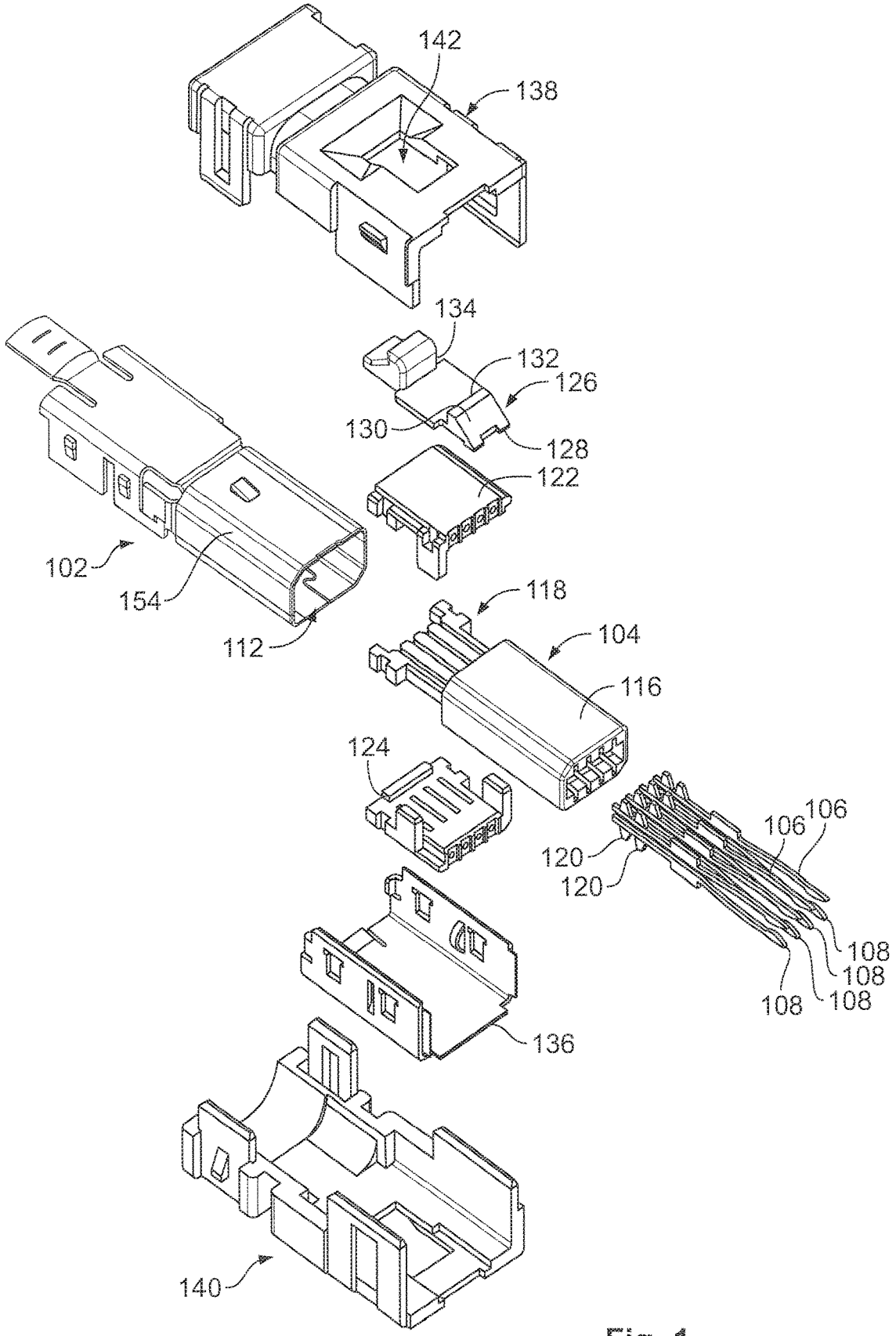
FIG. 1 is an exploded view of a plug according to the invention.
Figure 2:
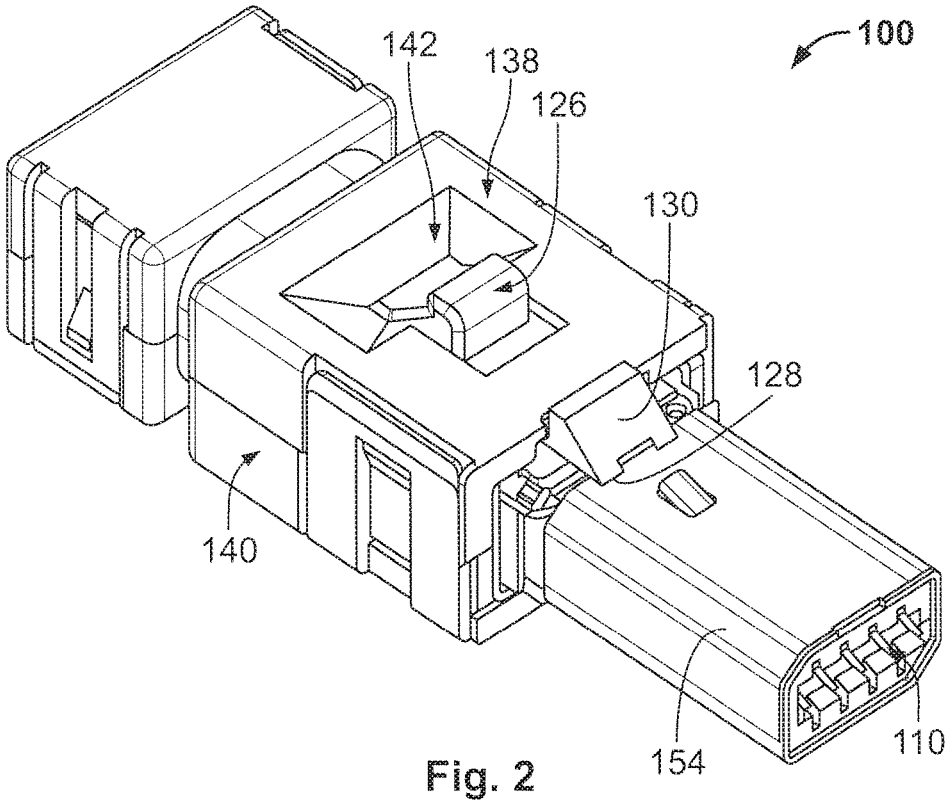
FIG. 2 is a perspective view of the plug of FIG. 1.
Figure 3:
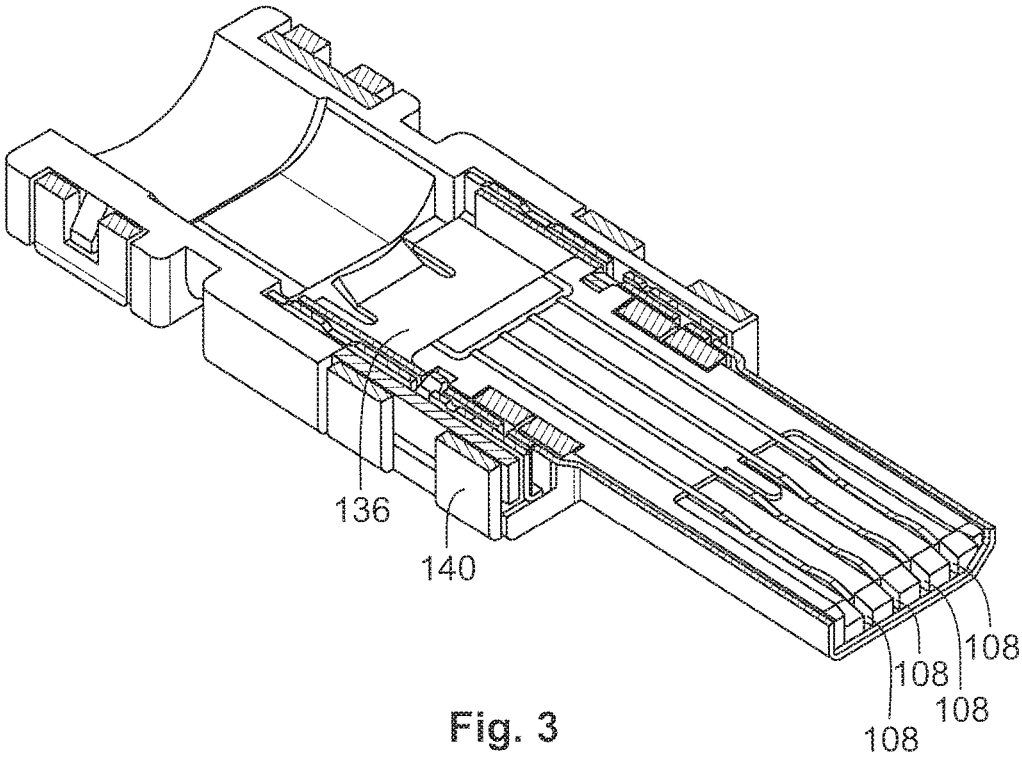
FIG. 3 is a sectional perspective view of the plug of FIG. 1.
Figure 4:
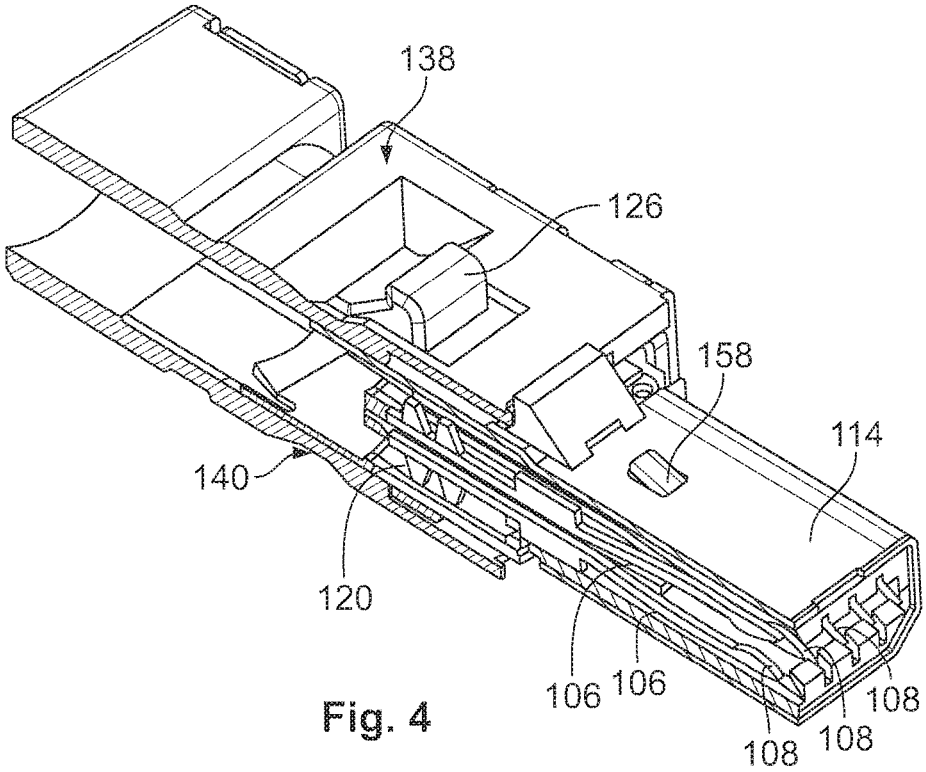
FIG. 4 is a sectional perspective view of the plug of FIG. 1.

The plug 100 is shown in FIGS. 1-5. The plug 100, as shown in FIG. 1, has a plug housing 102 made of bent sheet metal receiving a plug insert 104 made of a non-electrically conductive plastic material and adapted to hold eight plug contacts 106. Contact sections 108 of the plug contacts 106 are exposed within a receiving recess 110 of the plug insert 104. As shown in FIGS. 2, 3, and 4, the contact sections 108 are exposed at a free end of the plug insert 104 near the opening of the receiving recess 110 and the plug insert 104 is level with a housing opening 112 of the plug housing 102.

The plug housing 102 is made of bent sheet metal bent to define a cylindrical inserting section 114, as shown in FIG. 4. The plug insert 104 has a sleeve 116 at a proximal end with an outer circumferential surface essentially corresponding to the inserting section 114 made of bent sheet metal; the inserting section 114 thus cannot be bent inwardly due to the support of the sleeve 116. The distal end of the plug insert 104 has an essentially flat connection portion 118 provided with channels for each of the plug contacts 106. The plug contacts 106 are exposed with their free connecting ends 120 on both sides of the connection portion 118. The connecting ends 120 have teeth for connecting with isolated conductors of a cable. After connecting those conductors with the connecting ends 120, covers 122, 124, shown in FIG. 1, are snapped onto the connection portion 118 of the plug insert 104 to thereby cover the electrically conductive parts and isolate the connecting ends 120 from the metal plug housing 102.

A release member 126, as shown in FIGS. 1, 2, 4, and 5, is supported by an outer surface of the upper cover 122. The release member 126 has at its proximal end a releasing surface 128 defined by the forward end of a ramp 130 forming a forward step 132. The release member 126 also has a rearward step 134. On a side of the plug insert 104 opposite to the release member 126, there is provided a U-shaped bent shield 136 encompassing the inserting section 114 of the plug housing 102 in an assembled state of the plug 100, shown in FIG. 3, to make contact with a shielding of the cable.

The plug 100 also has two identical shells 138, 140, shown in FIG. 1, which are fastenable with each other to thereby encompass all elements previously described. The shells 138 have a release element receiving opening 142 adapted to receive the rearward step 134 of the release member 126 and having a longitudinal extension suitable to move the release member 126 from a rearward rest position to a forward release position defined by the forward and the rearward step 132, 134.

Figure 5:
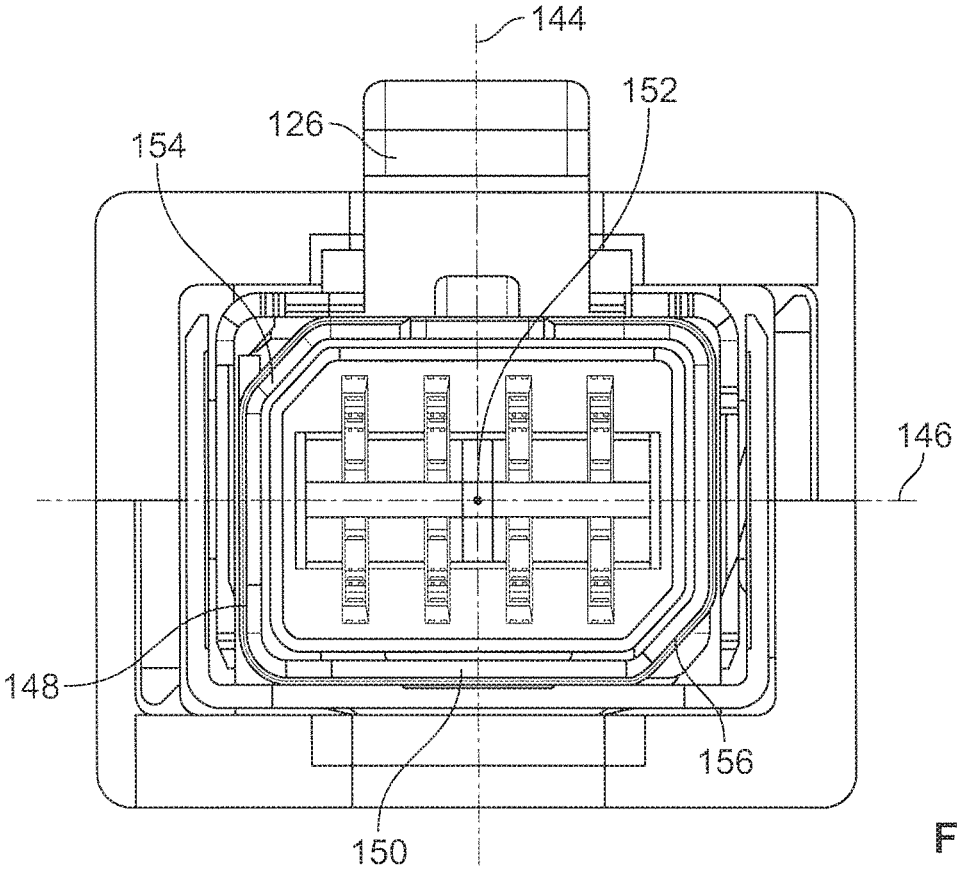
FIG. 5 is a front view of the plug of FIG. 1.

As shown in FIG. 5, the inserting section 114 has an essentially rectangular shape. A first axis 144 in FIG. 5 extends in a height direction of the height side surfaces 148 of the inserting section 114 and is in the middle between two opposing side walls of said inserting section 114 extending in height direction. A second axis 146 extends in a width direction and is arranged in the middle of the upper and the lower side surfaces 150 of the inserting section 114. The intersection between the two axes 144, 146 define a center point 152. The plug contacts 106 are each arranged symmetrically with respect to the second axis 146 and extend symmetrically with respect to the center point 152.

In the upper left and the lower right section divided by the two axes 144, 146, the sheet metal of the plug housing 102 is bent at the corner to define oblique corners which are male fit sections 154, 156. These male fit sections 154, 156 are identical and are symmetrical with respect to the center point 152. The male fit sections 154, 156 extend at an angle of 45° relative to each of the axes 144, 146. The male fit sections 154, 156 are positioned at the outer circumference of the cylindrical inserting section 114 of the metal plug housing 102. The cylindrical shape of said inserting section 114 is projected by a securing projection 158, shown in FIG. 4, which is made by cutting and bending the sheet metal forming the plug housing 102. The securing projection 158 is inclined to project towards the distal end of the plug 100.

Figure 6:
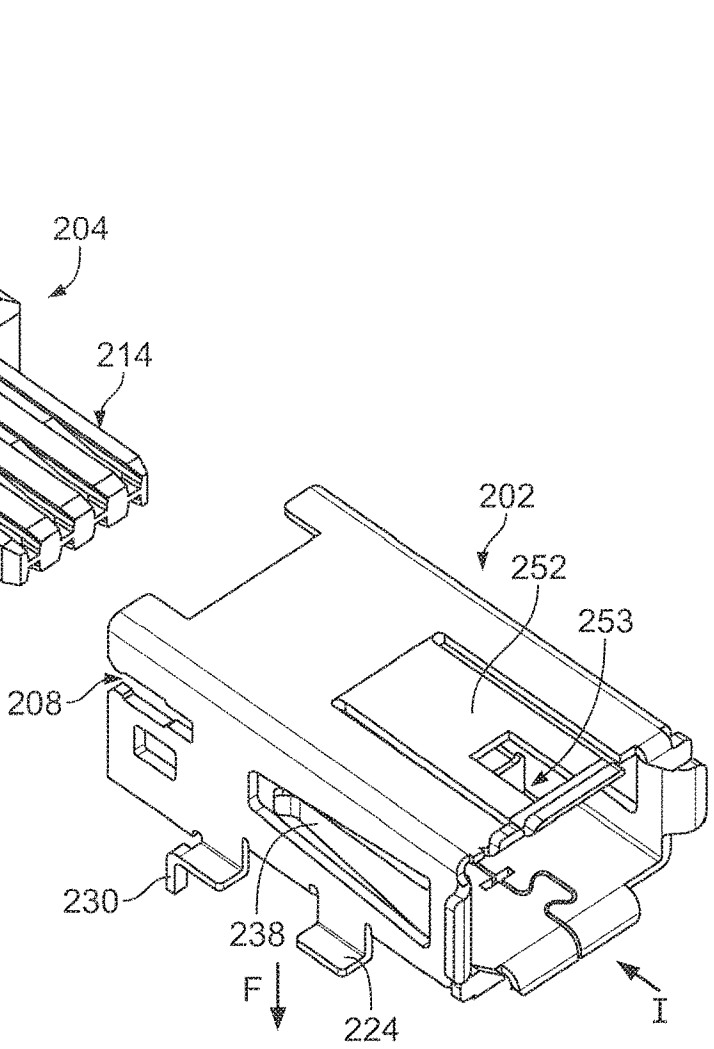
FIG. 6 is an exploded view of a jack according to the invention.

The jack 200 is shown in FIGS. 6-13. As shown in FIG. 6, the jack 200 has a jack housing 202 formed of bent sheet metal adapted to receive a unitary isolating jack insert 204 to be inserted into the rectangular jack housing 202 from a distal end. Proper alignment of the isolating jack insert 204 into the jack housing 202 is attained by a longitudinal rib 206 of the isolating jack insert 204 and longitudinal slots 208 open to the distal end of the jack housing 202. Eight jack contacts 210 are received in opposing longitudinal recesses of the isolating jack insert 204. Convex contact sections 212 of said jack contacts 210 are positioned relative to a proximal end of a male isolating section 214 of the isolating jack insert 204, which male isolating section 214 is adapted to be received in the receiving recess 110 of the plug 100. The jack contacts 210 have free solder ends 216 opposite the contact sections 212, which are offset by bending and extend parallel to a longitudinal direction corresponding to an inserting direction I.

Figure 10:
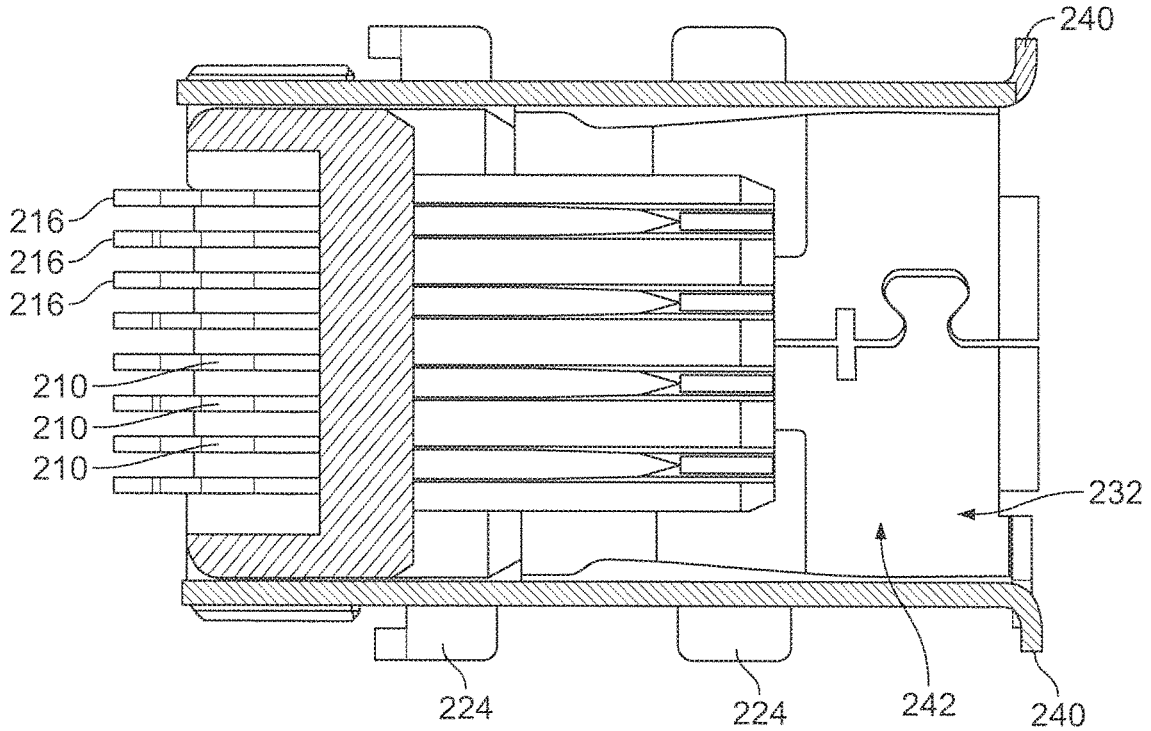
FIG. 10 is a sectional top view of the jack of FIG. 6.
Figure 11:
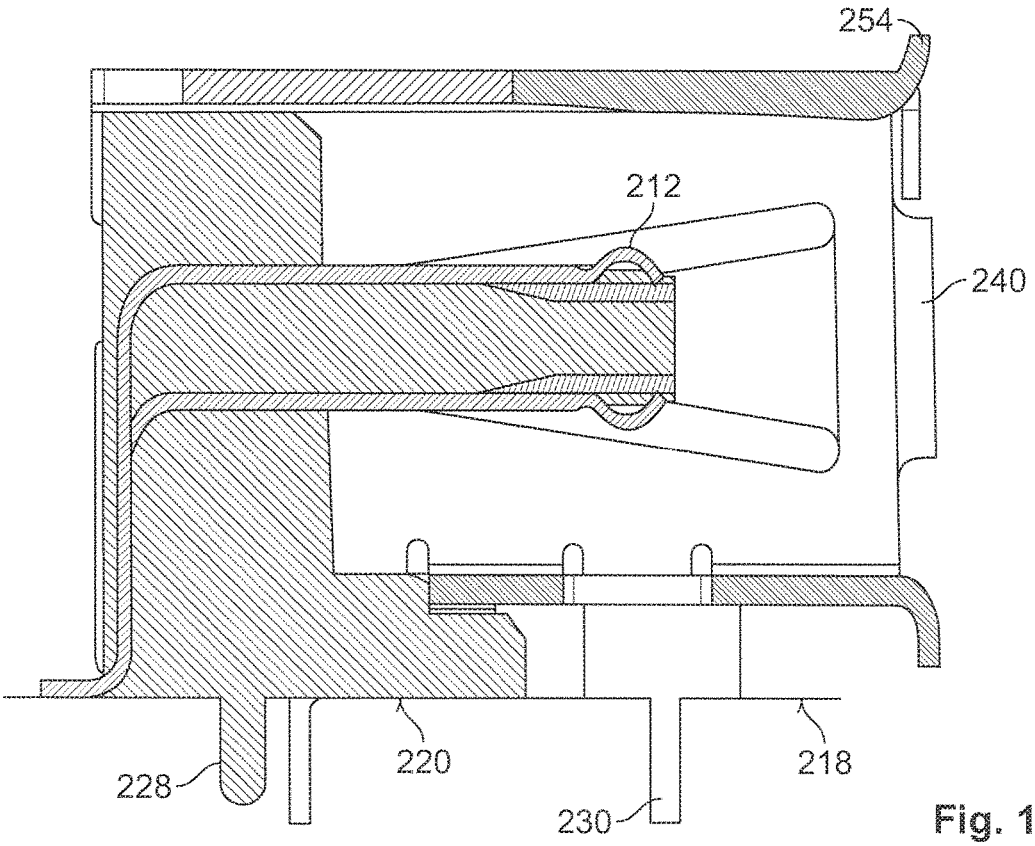
FIG. 11 is a sectional side view of the jack of FIG. 6.
Figure 12:
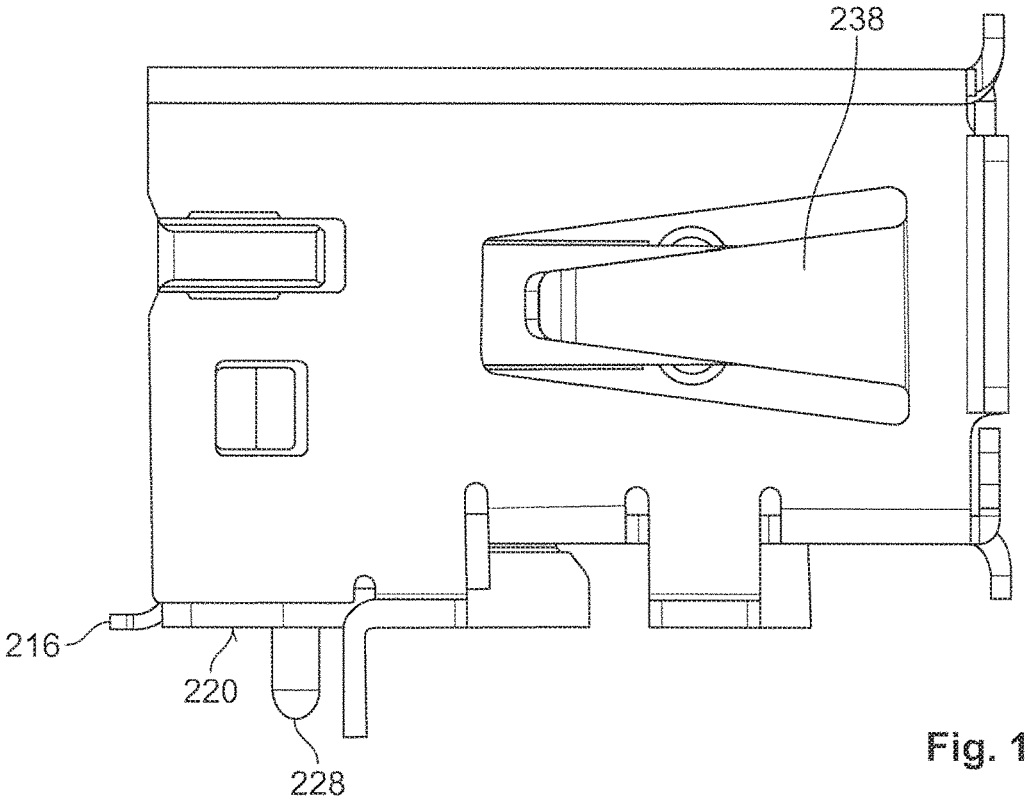
FIG. 12 is a side view of the jack of FIG. 6.

As shown in FIGS. 10, 11, and 12, the free solder ends 216 of the jack contacts 210 are approximately level with an abutment surface 218 partially formed by a bottom surface 220 of the isolating jack insert 204 and partially formed by portions of the metal jack housing 202. Those portions are in particular defined by second leg 222 of a solder pad 224, which is L-shaped to define a first leg 226 projecting from a main body of the jack housing 202 in a fastening direction F shown in FIG. 6.

Fastening projection 228 formed by the isolating jack insert 204, shown in FIG. 11, projects beyond the abutment surface 218. Pegs 230 formed by cutting and bending the sheet material defining the jack housing 202 also project beyond the abutment surface 218. Some of the pegs 230 are cut from the solder pad 224 and project beyond the second leg 222 in the fastening direction F. The fastening projections 228 and the pegs 230 are adapted to be received in recesses of a printed circuit board (PCB) for securely fastening the jack 200 thereto. The second leg 222 contacts the upper surface of the PCB for electrically contacting the metal jack housing 202 to conductive paths of the PCB. The solder pads 224 each define solder projections for securely connecting the jack 200 to the PCB.

Figure 7:
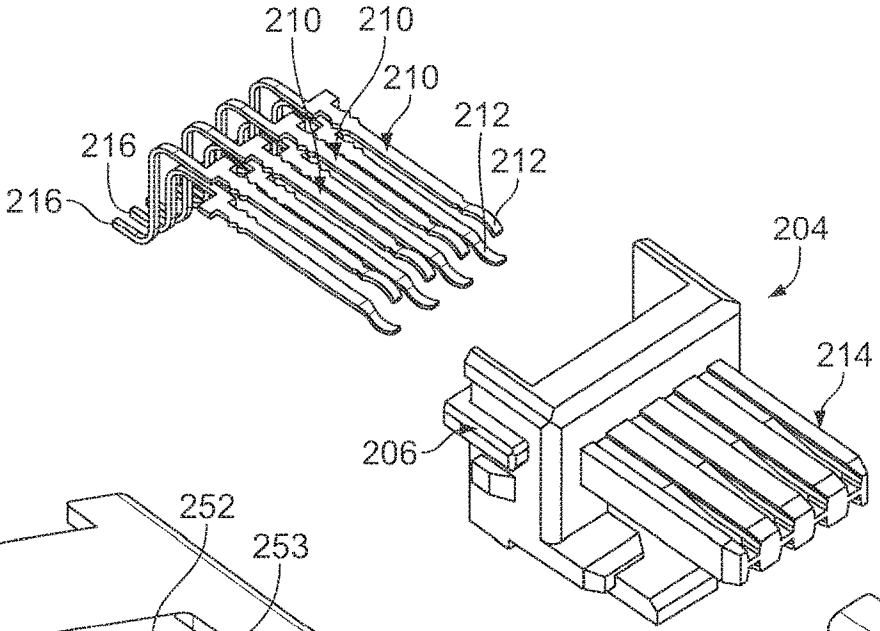
FIG. 7 is a perspective view of the jack of FIG. 6.
Figure 7:
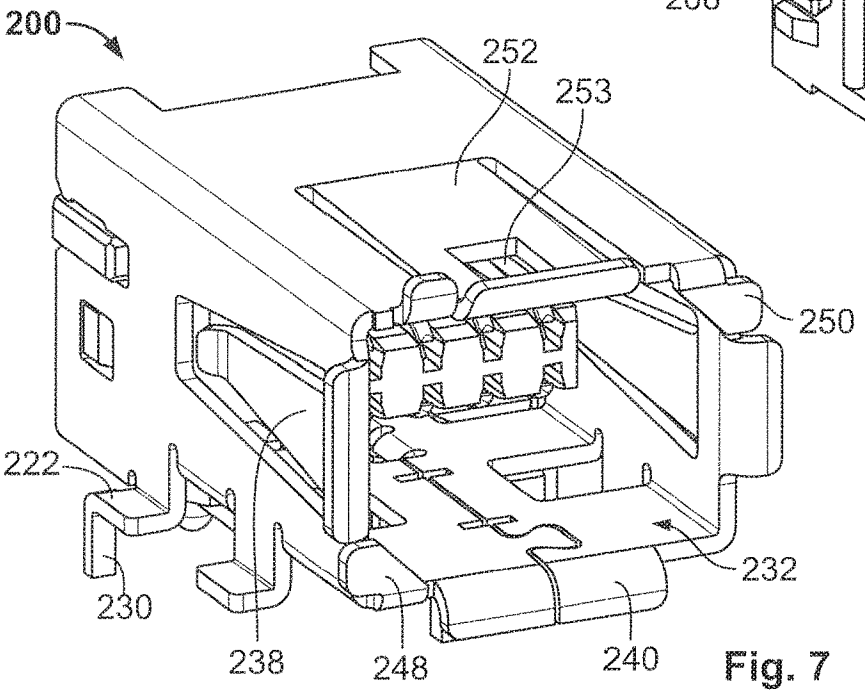
Figure 8:
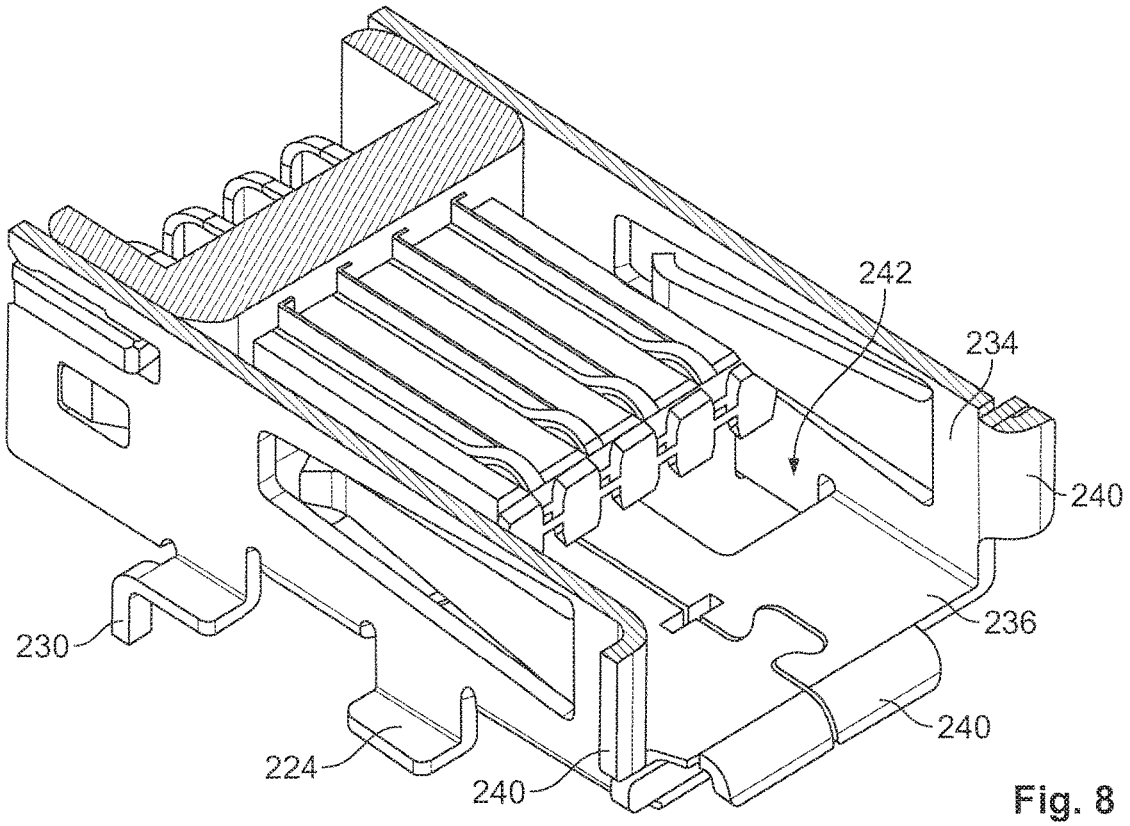
FIG. 8 is a sectional perspective view of the jack of FIG. 6.
Figure 9:
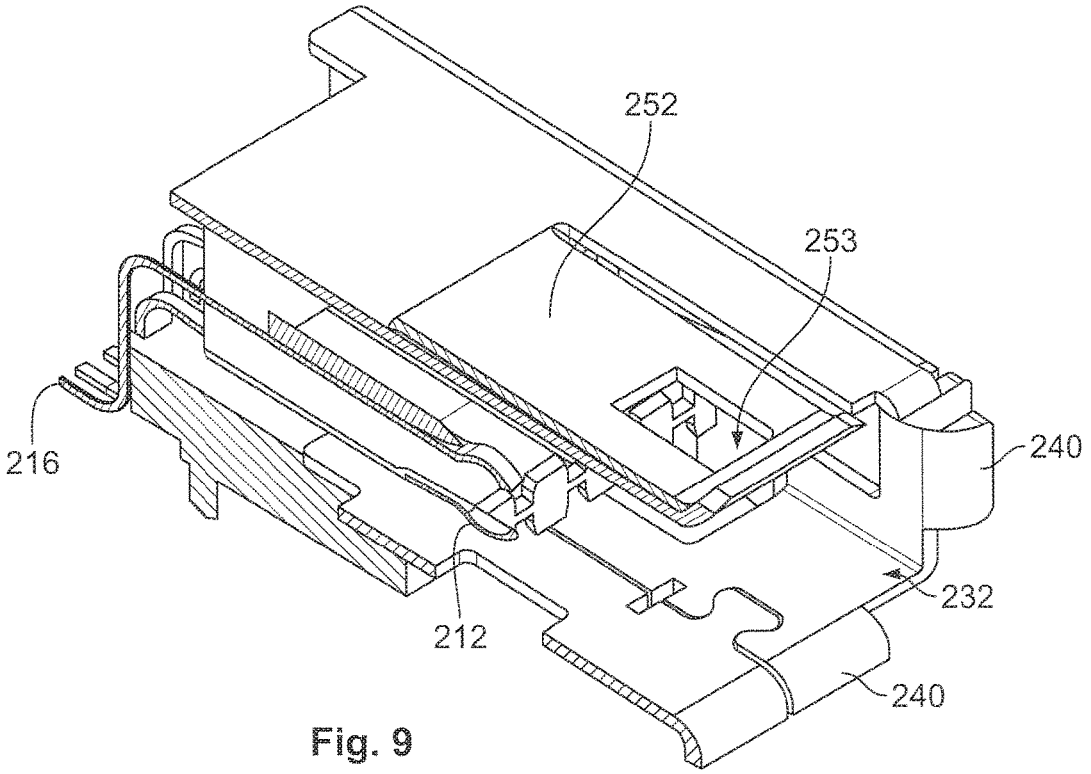
FIG. 9 is a sectional perspective view of the jack of FIG. 6.

The jack housing 202, as shown in FIGS. 6 and 7, defines a rectangular opening 232 adapted to receive the inserting section 114 of the plug 100 with opposing height side surfaces 234 and length side surfaces extending perpendicular thereto and having a longer extension than the height side surfaces 234. Projecting slightly inwardly towards the rectangular opening 232, there are provided resilient beams 238, which are cut from the sheet metal forming the jack housing 202 and are adapted to make electrical contact with the outer circumferential surface of the inserting section 114 of the plug 100. End sections 240 of the sheet metal, as shown in FIG. 7, project beyond the opening 232. The end sections 240 are bent outwardly to provide a funnel-shaped configuration leading to the rectangular opening 232. Behind said rectangular opening 232, there is provided a receiving section 242, shown in FIG. 8, which receives the inserting section 114 of the plug 100. The receiving section 242 has a rectangular form.

Figure 13:
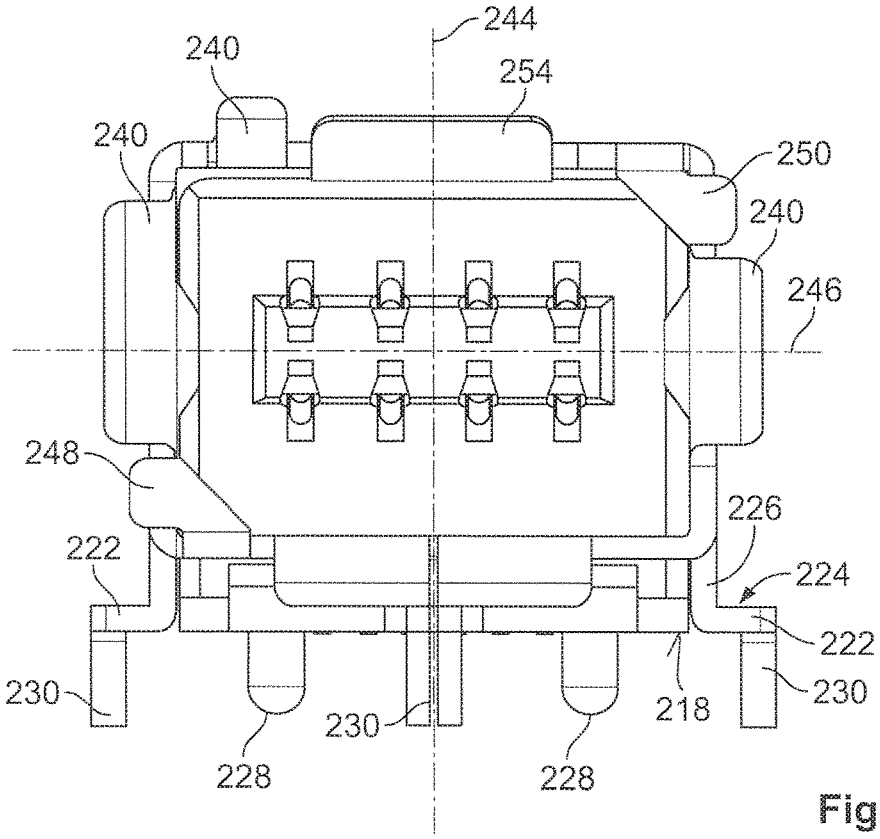
FIG. 13 is a front view of the jack of FIG. 6.

First and second axis 244, 246 are shown in FIG. 13 in accordance with those axes 144, 146 of FIG. 5. Two oblique corners forming female fit sections 248, 250 are provided, which partially cover the rectangular receiving section 242 and are adapted to cooperate with the male fit sections 154, 156 of the plug 100 for defining a coding, such that the plug 100 can only be inserted into the jack 200 in a predetermined way.

The upper of the length side surface 236 is provided with a pawl 252, shown in FIGS. 6 and 7, formed by cutting towards the opening 232 and bending the sheet material forming the jack housing 202 towards the rectangular opening 232. A free forward end 254 of the pawl 252 is bent outwardly as an end section 240. The rectangular opening 232 is thus delimited by the lateral side surfaces 234, 236, each being provided with end sections 240 and in addition with the outwardly bent free forward end 254 to define a funnel shape. The rectangular form, however, is partially blocked by the female fit sections 248, 250. The pawl 252 also has a securing opening 253 positioned rearward of the forward end 254.

When inserting the plug 100 into the jack 200, the inserting section 114 is inserted through the rectangular opening 232 in a coded orientation in which the male fit sections 154, 156 fit with the female fit sections 248, 250. Advancing the plug 100 into the jack 200, the securing projection 158 contacts the ramp-shaped free forward end 254, thereby lifting the pawl 250. The convex contact sections 212 of the jack contacts 210 are brought into contact with the corresponding contact sections 108 of the plug contacts 106. Further, the resilient beams 238 abut against the outer circumferential surface of the inserting section 114, thereby completing outer shielding of the plug contacts 106 and the jack contacts 210. The securing projection 158 is inserted into the securing opening 253 of pawl 252, securing the plug 100 to the jack 200.

For releasing the plug 100 and the jack 200, the release member 126 is advanced counter to the inserting direction I to thereby push the releasing surface 128 against the free forward end 254 of the pawl 252 thereby lifting the pawl 252, such that the plug 100 can be withdrawn from the jack 200.

Figure 14:
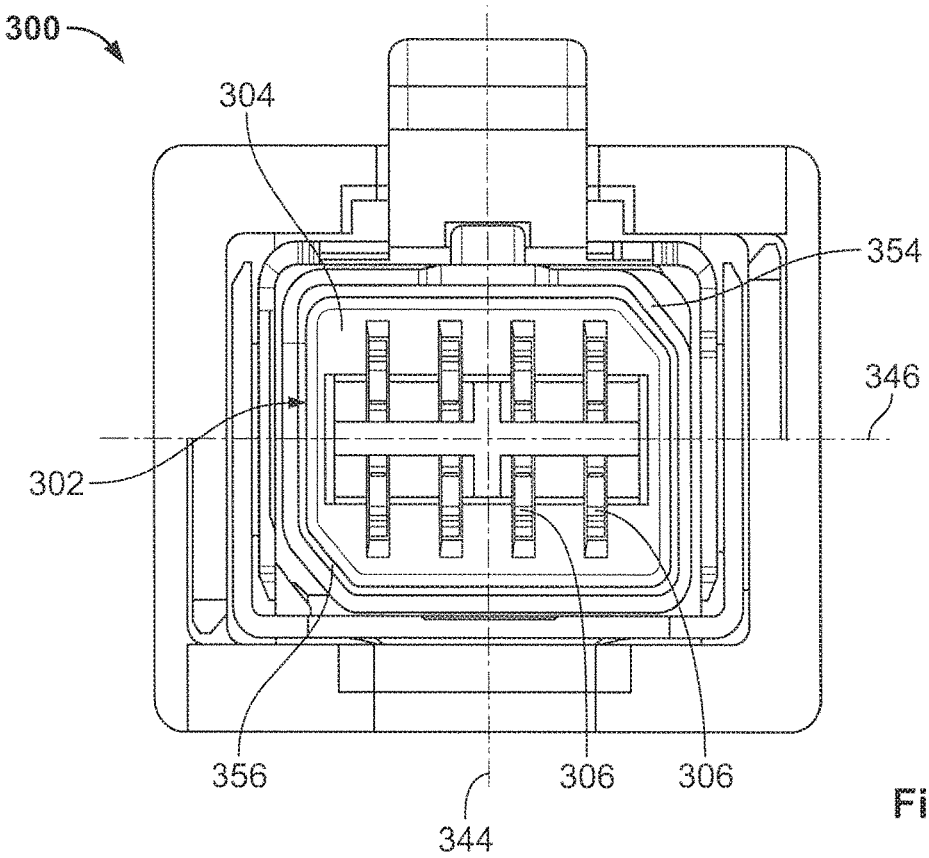
FIG. 14 is a front view of a plug according to another embodiment of the invention.
Figure 15:
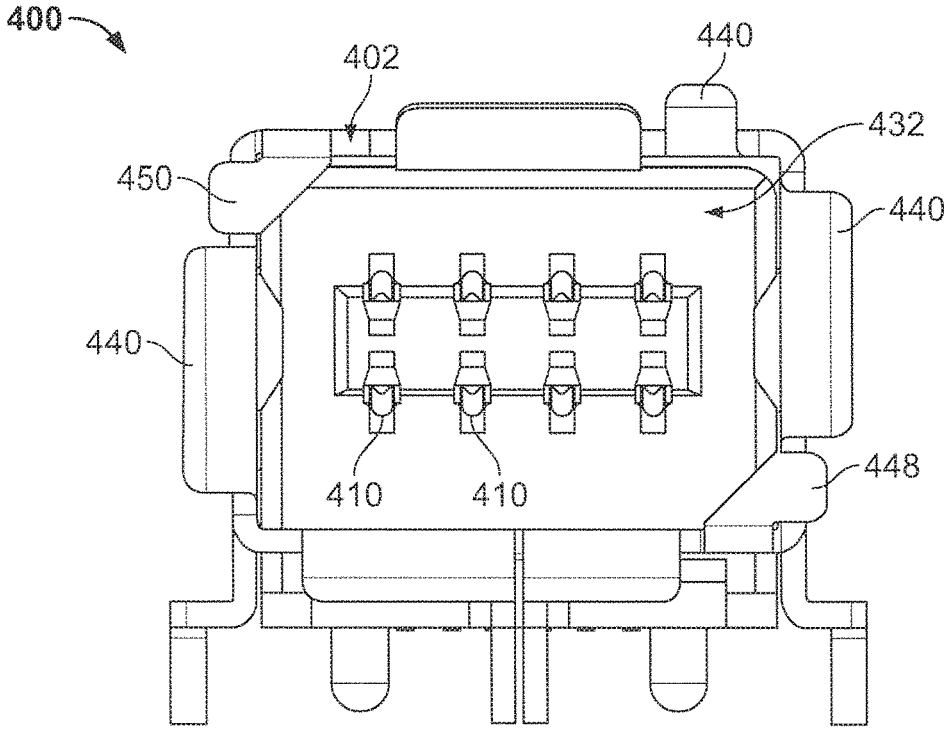
FIG. 15 is a front view of a jack according to another embodiment of the invention.

FIGS. 14 and 15 show a plug 300 and a jack 400 according to another embodiment of the invention. The plug 300 and the jack 400 have a different coding than the plug 100 and jack 200 shown in FIGS. 1-13. Oblique corners forming male fit sections 354, 356 of plug 300 are positioned at the upper right and the lower left quadrant divided by the first and the second axes 344, 346. Accordingly, an isolating plug insert 304 has a respective cross-sectional shape to correspond with this geometry of the metal plug housing 302. Otherwise, all parts of the plug 300 depicted in FIG. 14 are identical with those parts of plug 100 depicted in the FIGS. 1-5.

The jack 400 shown in FIG. 15 has a jack housing 402 defining oblique corners forming female fit sections 448, 450 in opposite upper left and lower right quadrants, while the jack 200 shown in FIGS. 6 through 13 has those oblique corner sections in upper right and lower left quadrants. Otherwise, all other shapes of both jacks 200, 400 are identical. The jack 200, 400 can be manufactured very economically as just the cutting and the bending of sections 248, 250 or 448, 450 at the end of the rectangular opening 232, 432 is individualized to realize different codings.

The plug 300 can be inserted into the jack 400, but not into jack 200. As the fit sections of each jack 200, 400 and each plug 100, 300 are identical, there is at least a theoretical possibility to invert the plug by 180° to insert such plug 300 into the jack 200. However, such positioning would not allow the securing projection 158 to be inserted into the securing opening 253 of pawl 252. Instead, the securing projection 158 would collide with the length side surface 236 at the bottom of the receiving section 242, which would prevent jack 200 and plug 300 from forming an electrical contact. Furthermore, the jack housing 202, 402 and the plug housing 102, 302 have a rather small size which does not exceed the size of the respective sections of an RJ 45 connector system.

Advantageously, according to the connector of the present invention, the housings have a coding which lead to the connection of a specific plug 100, 300 to a specific jack 200, 400 of the connector system without the possibility of mismatching different plugs and jacks.

What is claimed is:

1. A connector, comprising:

a plug having a plug housing surrounding a plurality of plug contacts and including a plurality of symmetric male fit sections and an insulative plug insert received within the plug housing and symmetrically supporting the plurality of plug contacts; and a jack receiving the plug and having a jack housing supporting a plurality of jack contacts corresponding to the plurality of plug contacts and an insulative jack insert received within the jack housing and symmetrically supporting the plurality of jack contacts, the jack housing having a rectangular receiving section receiving the plug housing, an end section of each of a pair of lateral side surfaces of the receiving section is bent outwardly and at least two corners of the receiving section are bent inwardly to project into the receiving section and define a plurality of symmetric female fit sections.

2. The connector of claim 1, wherein the plurality of plug contacts comprise at least eight plug contacts and the plurality of jack contacts comprise at least eight jack contacts.

3. The connector of claim 1, wherein the plug housing and the jack housing are each formed of bent sheet metal.

4. The connector of claim 1, wherein the plug housing has an inserting section inserted into the receiving section and having at least two oblique corners arranged opposite each other defining the male fit sections.

5. The connector of claim 4, wherein the jack housing has a resilient beam projecting into the receiving section and contacting an outer surface of the inserting section.

6. The connector of claim 4, wherein the jack housing has a pawl with a free end at an opening of the receiving section, the pawl capable of positively locking a securing projection of the inserting section.

7. The connector of claim 6, wherein the male fit sections, the female fit sections, the pawl, and the securing projection cooperate to only allow insertion of the plug into the jack in one predetermined orientation.

8. The connector of claim 7, wherein the plug has a release member movable with respect to the plug, the release member including a releasing surface capable of lifting the pawl from the securing projection.

9. The connector of claim 1, wherein the jack housing has a plurality of solder pads projecting beyond the receiving section in a fastening direction.

10. The connector of claim 9, wherein the jack housing has a plurality of pegs projecting beyond the receiving section in the fastening direction.

11. The connector of claim 10, wherein the jack insert has a fastening projection projecting beyond the receiving section in the fastening direction.

12. The connector of claim 11, wherein the jack housing and the jack insert define an abutment surface abutting a printed circuit board.

13. The connector of claim 12, wherein each of the jack contacts has a free solder end approximately level with the abutment surface.

14. The connector of claim 1, wherein each of the plug contacts has a contact section and an opposite connecting end, each contact section disposed within a sleeve of the plug insert.

15. The connector of claim 14, wherein each connecting end is exposed from the sleeve and supported by a connection portion of the plug insert.

16. The connector of claim 15, wherein the connection portion is covered by a cover connectable to the plug insert.

17. The connector of claim 4, wherein the plug housing is disposed within a pair of fastenable shells such that the inserting section is exposed.

18. A jack of a connector, comprising:

a jack housing formed of bent sheet material supporting a plurality of jack contacts and having a rectangular receiving section, an end section of each of a pair of lateral side surfaces of the receiving section is bent outwardly and at least two corners of the receiving section are bent inwardly to project into the receiving section and define a plurality of symmetric female fit sections.

19. A connector set, comprising:

a first connector comprising a first plug having a first plug housing surrounding a plurality of first plug contacts and including a plurality of symmetric first male fit sections, and a first jack receiving the first plug and having a first jack housing supporting a plurality of first jack contacts corresponding to the plurality of first plug contacts, the first jack housing including a rectangular receiving section receiving the first plug housing, an end section of each of a pair of lateral side surfaces of the receiving section is bent outwardly and at least two corners of the receiving section are bent inwardly to project into the receiving section and define a plurality of symmetric first female fit sections; and a second connector comprising a second plug having a second plug housing surrounding a plurality of second plug contacts and including a plurality of symmetric second male fit sections, and a second jack receiving the second plug and having a second jack housing supporting a plurality of second jack contacts corresponding to the plurality of second plug contacts, the second jack housing including a plurality of symmetric second female fit sections, the first jack cannot receive the second plug and the second jack cannot receive the first plug.

* * * * *